US010667036B2

(12) United States Patent
Kim

(10) Patent No.: US 10,667,036 B2
(45) Date of Patent: May 26, 2020

(54) LATTICE TYPE SPEAKER AND LATTICE ARRAY SPEAKER SYSTEM HAVING SAME

(71) Applicant: Tae Hyung Kim, Incheon (KR)

(72) Inventor: Tae Hyung Kim, Incheon (KR)

( * ) Notice: Subject to any disclaimer, the term of this patent is extended or adjusted under 35 U.S.C. 154(b) by 0 days.

(21) Appl. No.: 15/127,346

(22) PCT Filed: Mar. 20, 2015

(86) PCT No.: PCT/KR2015/002721
§ 371 (c)(1),
(2) Date: Sep. 19, 2016

(87) PCT Pub. No.: WO2015/142097
PCT Pub. Date: Sep. 24, 2015

(65) Prior Publication Data

US 2017/0134846 A1 May 11, 2017

(30) Foreign Application Priority Data

Mar. 20, 2014 (KR) ..... 10-2014-0033049

(51) Int. Cl.
*H04R 1/24* (2006.01)
*H04R 1/30* (2006.01)
(Continued)

(52) U.S. Cl.
CPC ..... *H04R 1/24* (2013.01); *H04R 1/026* (2013.01); *H04R 1/30* (2013.01); *H04R 1/345* (2013.01); *H04R 3/14* (2013.01); *H04R 2201/401* (2013.01)

(58) Field of Classification Search
CPC ... H04R 1/24; H04R 1/26; H04R 1/30; H04R 1/345; H04R 2201/401; H04R 2201/403
See application file for complete search history.

(56) References Cited

U.S. PATENT DOCUMENTS 2,852,087 A * 9/1958 Ruschhaupt ..... H04R 1/2826 181/151
2,856,467 A * 10/1958 Hoodwin ..... G10K 11/025 181/188
(Continued)

FOREIGN PATENT DOCUMENTS

KR 2019970023960 3/1999
KR 1002739410000 5/1999
(Continued)

*Primary Examiner* — Joshua Kaufman
(74) *Attorney, Agent, or Firm* — Maschoff Brennan

(57) ABSTRACT

Disclosed are a lattice type speaker and a lattice array speaker system having the same. A lattice type speaker according to the present invention comprises: a tweeter horn which has a quadrangular part forming an upper periphery thereof and four woofer frames provided at or inside a cut-off edge part of the quadrangular part, so that the tweeter horn is implemented as a lattice horn having a horn-shaped entire body configuration and a cross shape when viewed from above; a tweeter driving unit which is provided on a lower side of the tweeter horn and reproduces a high-pitched sound through the tweeter horn; four woofer horns provided inside the four woofer frames, respectively; and a woofer driving unit which is provided on a lower side of the four woofer horns and reproduces a low-pitched sound through the four woofer horns.

32 Claims, 10 Drawing Sheets

(51) Int. Cl.

| | |
|---|---|
| ***H04R 1/02*** | (2006.01) |
| ***H04R 1/34*** | (2006.01) |
| *H04R 3/14* | (2006.01) |

(56) References Cited

U.S. PATENT DOCUMENTS 3,026,957 A * 3/1962 Gladstone ..... H04R 1/22 181/147
3,028,927 A * 4/1962 Levy ..... H04R 1/30 381/182
3,065,816 A * 11/1962 Ranger ..... H04R 5/02 181/147
3,898,384 A * 8/1975 Goeckel ..... H04R 1/2865 181/147
3,931,867 A * 1/1976 Janszen ..... H04R 1/24 181/144
3,982,607 A * 9/1976 Evans ..... G10K 11/24 181/151
4,112,256 A * 9/1978 Carlsson ..... H04R 1/323 181/154
4,165,797 A * 8/1979 Spetalnik ..... H04R 5/02 181/147
4,182,429 A * 1/1980 Senzaki ..... H04R 1/24 181/141
4,227,051 A * 10/1980 Thomas ..... H04R 1/24 181/144
4,283,606 A * 8/1981 Buck ..... H04R 1/24 181/144
4,314,620 A * 2/1982 Gollehon ..... H04R 1/26 181/144
4,348,549 A * 9/1982 Berlant ..... H04R 1/26 181/152
4,381,831 A * 5/1983 Putnam ..... G10K 11/025 181/152
4,391,346 A * 7/1983 Murakami ..... H04R 1/227 181/147
4,418,248 A * 11/1983 Mathis ..... H04R 1/26 381/190
4,524,846 A * 6/1985 Whitby ..... H04R 1/30 181/147
4,554,414 A * 11/1985 House ..... H04R 23/02 181/144
4,619,342 A * 10/1986 Buck ..... H04R 9/063 181/144
4,633,229 A * 12/1986 Iacono ..... G10K 11/025 181/144
4,733,749 A * 3/1988 Newman ..... H04R 1/227 181/144
4,811,403 A * 3/1989 Henricksen ..... H04R 1/02 181/152
4,845,759 A * 7/1989 Danley ..... G10K 11/025 181/187
4,882,562 A * 11/1989 Andrews ..... G10K 11/02 181/185
5,004,067 A * 4/1991 Patronis ..... H04R 1/30 181/188
5,020,630 A * 6/1991 Gunness ..... G10K 11/025 181/187
5,046,581 A * 9/1991 Mitchell ..... H04R 1/26 181/152
5,109,423 A * 4/1992 Jacobson ..... H04R 1/30 381/336
5,430,260 A * 7/1995 Koura ..... H04R 1/26 181/144
5,432,860 A * 7/1995 Kasajima ..... H04R 1/30 181/152
5,526,456 A * 6/1996 Heinz ..... H04R 1/26 181/152
5,750,943 A * 5/1998 Heinz ..... H04R 1/403 181/152
5,874,695 A * 2/1999 Tracy ..... H04R 1/26 181/147
5,900,593 A * 5/1999 Adamson ..... G10K 11/30 181/144
6,343,134 B1 * 1/2002 Czerwinski ..... H04R 1/26 381/182
6,411,718 B1 * 6/2002 Danley ..... H04R 1/26 181/144
6,628,796 B2 * 9/2003 Adamson ..... H04R 1/26 181/152
6,712,177 B2 * 3/2004 Ureda ..... H04R 1/30 181/152
6,801,631 B1 * 10/2004 North ..... H04R 1/26 181/148
6,896,096 B2 * 5/2005 Nevill ..... H04R 1/26 181/148
6,981,570 B2 * 1/2006 Dalbec ..... G10K 11/025 181/152
7,134,523 B2 * 11/2006 Engebretson ..... H04R 1/26 181/144
7,177,437 B1 * 2/2007 Adams ..... H04R 1/30 381/337
7,275,621 B1 * 10/2007 Delgado, Jr. ..... G10K 11/025 181/150
7,298,860 B2 * 11/2007 Engebretson ..... H04R 1/026 381/335
7,392,880 B2 * 7/2008 Buck ..... H04R 1/30 181/144
7,454,029 B2 * 11/2008 Andrews ..... H04R 1/403 381/335
8,130,994 B2 * 3/2012 Button ..... H04R 1/24 181/155
8,189,822 B2 * 5/2012 Jakowski ..... H04R 1/26 381/182
8,224,001 B1 * 7/2012 Waller ..... H04R 1/24 181/145
8,452,038 B2 * 5/2013 Buccafusca ..... G10K 11/025 181/187
9,191,734 B2 * 11/2015 Sporer ..... H04R 1/26
9,344,785 B1 * 5/2016 Tracy ..... H04R 1/26
2003/0142844 A1 * 7/2003 Rivera ..... H04R 1/24 381/335
2004/0003961 A1 * 1/2004 Gunness ..... H04R 1/30 181/189
2004/0005069 A1 * 1/2004 Buck ..... H04R 1/30 381/336
2005/0201583 A1 * 9/2005 Colich ..... H04R 1/403 381/335
2009/0310808 A1 * 12/2009 Button ..... H04R 1/24 381/339
2016/0277830 A1 * 9/2016 Combet ..... H04R 1/323

FOREIGN PATENT DOCUMENTS

KR 1010673860000 4/2009
KR 1010351830000 6/2010

* cited by examiner

LATTICE TYPE SPEAKER AND LATTICE ARRAY SPEAKER SYSTEM HAVING SAME

CROSS-REFERENCE TO RELATED APPLICATIONS

The present application is a U.S. National Phase of PCT/KR2015/002721 filed on Mar. 20, 2015 claiming priority to Korean Patent application No. 10-2014-0033049 filed on Mar. 20, 2014. The disclosure of the PCT Application is hereby incorporated by reference into the present Application.

TECHNICAL FIELD

The present invention relates to a lattice type speaker and a lattice array speaker system having same.

In particular, the present invention relates to a lattice type speaker and a lattice array speaker system having same, wherein a tweeter horn forming a speaker is made of a lattice horn, and a lattice horn has a top surrounding formed of a quadrangular shape part, and a woofer frame accommodating a woofer horn is provided at an inner side of a cutoff corner part or a right angle corner part of the quadrangular shape part, and the entire body configuration is a horn type and looks like a cross when viewing from the top, and a transfer distance and a range of a high-pitched sound and a low-pitched sound can be greatly increased, so a sound field can be formed, by which sound can be transferred wider and farther as compared to a conventional technology, and a wave front may form one plane wave at a portion where high-pitched tones from a plurality of lattice type speakers are superposed, thus preventing an interference phenomenon, for which a high-pitched sound can be well transferred irrespective of the positions of audience, for example, in a theater.

BACKGROUND ART

The speaker, in general, is a device to generate sound in such a way to convert an electrical energy into a physical energy, wherein the device is able to generate an acoustic or high or low sound based on a sound source.

The aforementioned speaker may be categorized based on a producing method into a moving coil type dynamic speaker, an electrostatic speaker, a ribbon speaker, and a piezoelectric speaker. As another type of a speaker, there is a coaxial speaker.

Moreover, in order to maximize a performing effect at a theater, for example, a concert theater, a line speaker system, which is a large speaker system, is mainly used, wherein a plurality of speakers are connected in series in one direction (for example, an upward and downward direction).

FIG. 1A is a cross sectional view illustrating a conventional coaxial speaker.

Referring to FIG. 1A, the coaxial speaker includes a low-pitched tone speaker 11 which corresponds to a woofer configured to reproduce a low-pitched sound, a high-pitched sound speaker 13 which corresponds to a tweeter installed at an upper portion of the low-pitched sound speaker 11 and configured to product a high-pitched sound, and a connection member 15 configured to connect the low-pitched sound speaker 11 and the high-pitched sound speaker 13 to a coaxial portion. The lower portion of the connection 15 is inserted into the low-pitched sound speaker 11, and the high-pitched sound speaker 13 is accommodated in the upper portion thereof. In this way, the low-pitched sound speaker 11 and the high-pitched sound speaker 13 can be connected to the coaxial portion.

In the aforementioned conventional coaxial speaker, since the low-pitched sound speaker 11 and the high-pitched sound speaker 13 are integrally connected to the connection member 15, the position of the high-pitched sound speaker 13 can't be adjusted. For this reason, it is impossible to product various sound qualities due to the position adjustment (an orienting angle adjustment) of the high-pitched speaker 13, thus causing a disadvantage.

According to another conventional technology which is suggested to resolve the aforementioned problems, an improved coaxial speaker has been developed, which is able to adjust the position of the high-pitched sound speaker.

More specifically, FIG. 1B is a cross sectional view illustrating the conventional technology improved coaxial speaker, and FIG. 1C is a disassembled perspective view illustrating the first and the second support members in FIG. 1B.

Referring to FIGS. 1B and 1C, the improved coaxial speaker includes a low-pitched sound speaker (a woofer) 110 configured to reproduce a low-pitched sound, and a high-pitched sound speaker 120 which positions coaxial with the low-pitched sound speaker 110 with respect to a virtual vertical line and generally positions higher than the low-pitched sound speaker 110 and is configured to reproduce a high-pitched sound. In this case, the surface facing the low-pitched sound speaker 110 with respect to a virtual vertical line is defined as a lower surface, and the surface facing high-pitched sound speaker 120 is defined at an upper surface.

The low-pitched sound speaker 110 includes the first frame 111, the first plate 113 engaged to the lower surface of the first frame 111, the first magnet 114 engaged to the lower surface of the first plate 113, the first yoke 115 engaged to the lower surface of the first magnet 114, the first vibration plate 117 a rim portion of which is engaged to the first frame 111, and the first voice coil 118 an upper portion of which is engaged to a central portion of the first vibration plate 117, and a lower portion of which positions between the first plate 113 and the first yoke 115. If an external electric power is supplied to the first voice coil 118, the first voice coil 118 will vibrate upward and downward by the operations of the first voice coil 118 and the first magnet 114, by which the first vibration plate 177 will vibrate upward and downward, thus producing a low-pitched acoustic.

Meanwhile, the high-pitched sound speaker 120 includes the second frame 121, the second yoke 123 engaged to the inner surface of the second frame 121, the second magnet 124 and the second plate 125 which are laminated in order inside of the second yoke 123 at a predetermined interval from the inner surface of the second yoke 123, the second vibration plate 127 a rim portion of which is engaged to the second frame, and the second voice coil 128 an upper portion of which is engaged to the second vibration plate 127, and a lower portion of which positions between the second yoke 123 and the second plate 125. If an external current is supplied to the second voice coil 128, the second voice coil 128 will vibrate upward and downward by the operations of the second voice coil 128 and the second magnet 124, by which the second vibration plate 127 will vibrate upward and downward, thus producing a high-pitched acoustic.

The low-pitched sound speaker 110 and the high-pitched sound speaker 120 are connected to a coaxial portion with the aid of the first support member 130 and the second support member 140. The rotation and the orienting angle of the high-pitched sound speaker 120 of the embodiment can be adjusted by the first and the second support members 130 and 140.

More specifically, a lower portion of the first support member 130 is fixed at the low-pitched sound speaker 110, and an upper portion thereof can rotate about a virtual vertical line. The first support member 130 includes a lower support member 131, an intermediate support member 134 and an upper support member 137. Moreover, the lower support member 131 is formed in a cylindrical shape, and an outer circumferential surface of the lower portion thereof is fixedly inserted into the first yoke 115. A support rim 131*a* protruding outward is formed at an outer circumferential surface of the central portion of the lower support member 131, and a plurality of first engaging protrusions 131*b* are formed in the longitudinal direction at an outer circumferential surface of the upper portion thereof.

The conventional technology coaxial speaker in FIG. 1A to FIG. 1C has the Korean patent application No. 10-2007-0080525 which was filed on Aug. 10, 2007 by Jung, Changgyu with the title of "a coaxial speaker". This was registered on Jun. 3, 2009, and the contents thereof are described in detail in the Korean patent registration No. 10-0902089.

In the conventional technology coaxial speaker in FIG. 1A to FIG. 1C, it is advantageous that the low-pitched sound speakers 11 and 110 and the high-pitched sound speakers 13 and 120 can be connected coaxial, and the rotation and orienting angle of the high-pitched sound speaker 120 can be adjusted by the first and the second support members 130 and 140, but the following problems has remain occurred.

More specifically, FIG. 1D is a schematic view illustrating a propagation state of a high-pitched sound when the conventional technology coaxial speaker is used.

Referring to FIG. 1D, in the conventional technology, the low-pitched sound speakers 11 and 110 are equipped with a large horn-shaped the first vibration plate 117, while the high-pitched sound speakers 13 and 120 are equipped with a relatively smaller convex curve-shaped the second vibration plate 127. As illustrated in FIG. 1D, a high-pitched sound reproduced from the high-pitched sound speakers 13 and 120 can spread within an orienting angle range (a relatively narrower range) along the second frame 121. If the speaker in FIG. 1D is used alone, there may not be any interference phenomenon, but if a line array speaker system is used, wherein a plurality of speakers are arranged in upper and lower and leftward and rightward directions while neighboring with each other, a high-pitched sound having a relatively shorter wavelength/high frequency than a low-pitched sound may be likely to cause an interference phenomenon with another high-pitched sound which is reproduced from another speaker among a plurality of the speakers. For example, a problem occurs, wherein a high-pitched sound is not well transferred or heard weak to an audience who is at a predetermined position in a wider performing theater.

More specifically, FIG. 1E is a schematic view illustrating a propagation state of a high-pitched sound if a line speaker system is used, wherein a plurality of conventional technology coaxial speakers are connected in one direction. As illustrated in FIG. 1E, a line speaker system is illustrated, wherein three coaxial speakers are disposed in line, and it is obvious that two or four or more than four coaxial speakers can be used.

Referring to FIG. 1E, according to the conventional technology line array speaker system, a high-pitched sound reproduced from each coaxial speaker, as illustrated in FIG. 1D, will spread along the second frame 121. In this case, since the vibration plates 127 of each high-pitched sound speaker 120 are disposed spaced-apart from each other, the wave fronts (WF1, WF2, WF3) of a high-pitched tone reproduced from each vibration plate 127 may be superposed. A constructive interference (CI) may occur where a high-pitched sound wavelength does not have any path difference or corresponds to even number multiples of a half wavelength, and a destructive interference (DI) may occur where a high-pitched sound wavelength corresponds to odd number multiples of a half wavelength. If a conventional line speaker system illustrated in FIG. 1E is used in a performing theater, there may be a problem wherein a high-pitched sound may not be transferred to an audience who is at a position where a destructive interference occurs or may be heard weak.

In order to resolve the aforementioned conventional technology problems, it needs to develop a new resolution.

DESCRIPTION OF THE INVENTION

Technical Problems

Accordingly, the present invention has been resolved the above mentioned problems, It is an object of the present invention to provide a lattice type speaker and a lattice array speaker system having same, wherein a tweeter horn forming a speaker is made of a lattice horn, and a lattice horn has a top surrounding formed of a quadrangular shape part, and a woofer frame accommodating a woofer horn is provided at an inner side of a cutoff corner part or a right angle corner part of the quadrangular shape part, and the entire body configuration is a horn type and looks like a cross when viewing from the top, and a transfer distance and a range of a high-pitched sound and a low-pitched sound can be greatly increased, so a sound field can be formed, by which sound can be transferred wider and farther as compared to a conventional technology, and a wave front may form one plane wave at a portion where high-pitched sound from a plurality of lattice type speakers are superposed, thus preventing an interference phenomenon, for which a high-pitched sound can be well transferred irrespective of the positions of audience, for example, in a theater.

Means for Solving Problems

A lattice type speaker according to the first aspect of the present invention comprises: a tweeter horn which has a quadrangular part, forming an upper periphery thereof and four woofer frames provided at or inside a cut-off edge part of the quadrangular part, so that the tweeter horn is implemented as a lattice horn having a horn type entire body and a cross type when viewed from above; a tweeter driver unit which is provided on a lower side of the tweeter horn and reproduces a high-pitched sound through the tweeter horn; four woofer horns provided inside the four woofer frames, respectively; and a woofer driver unit which is provided on a lower side of the four woofer horns and reproduces a low-pitched sound through the four woofer horns.

A lattice type speaker according to the second aspect of the present invention comprises; the tweeter horn which has a quadrangular part, forming an upper periphery thereof and two upper and lower woofer frames provided at or inside of a cut-off edge part or quadrangular part, and the upper and lower side of the entire body are formed in an asymmetrical horn type, and the tweeter horn is implemented with an asymmetrical lattice horn looking like a cross type when viewed from above; a tweeter driver unit which is provided on a lower side of the tweeter horn and reproduces a high-pitched sound through the tweeter horn; two upper and lower woofer horns provided inside of the two upper and lower woofer frames, respectively; and a woofer driver unit which is provided below each of the two upper and lower woofer horns and reproduces a low-pitched sound through the two upper and lower woofer horns.

Lattice array speaker system according to the third aspect of the present invention comprises; a plurality of lattice type speakers which are arranged and connected along a plane in a direction between a horizontal plane direction and a vertical plane direction or a plane in both the directions, wherein each of a plurality of the lattice type speakers may include, which has a each of quadrangular part, forming an upper periphery thereof and four woofer frames provided at or inside a cut-off edge part of the quadrangular part, so that the tweeter horn is implemented as a lattice horn having a horn type entire body and a cross type when viewed from above; a tweeter driver unit which is provided on a lower side of the tweeter horn and reproduces a high-pitched sound through the tweeter horn; four woofer horns provided inside the four woofer frames, respectively; and a woofer driver unit which is provided on a lower side of the four woofer horns and reproduces a low-pitched sound through the four woofer horns.

Lattice array speaker system, according to the fourth aspect of the present invention, comprises; a plurality of lattice type speakers which are arranged and connected along any of the first curved surface in the horizontal direction and the second curved surface in the vertical direction or along a curved surface in both the directions, wherein each of a plurality of the lattice type speakers may include, the tweeter horn which has a quadrangular part, forming an upper periphery thereof and two upper and lower woofer frames provided at or inside of a cut-off edge part or right angle and quadrangular part, and the upper and lower side of the entire body are formed in an asymmetrical horn type, and the tweeter horn is implemented with an asymmetrical lattice horn looking like a cross type when viewed from above; a tweeter driver unit which is provided on a lower side of the tweeter horn and reproduces a high-pitched sound through the tweeter horn; two upper and lower woofer horns provided inside of the two upper and lower woofer frames, respectively; and a woofer driving unit which is provided below each of the two upper and lower woofer horns and reproduces a low-pitched sound through the two upper and lower woofer horns.

Advantageous Effects of the Invention

The following advantageous effects can be obtained if the lattice type speaker and the lattice array speaker having same according to the present invention are employed.

1. Since the sound from the lattice type speaker may focus on in a predetermined direction, the transfer distance and range of a high-pitched sound and a low-pitched sound can greatly increase. Consequently, it is possible to form a sound field with which the transfer distance of a sound is wider and farther as compared to a conventional technology, thus obtaining a desirable acoustic effect in a wider space.

2. Since the lattice horn employed in a lattice type speaker can have an increased horizontal and vertical direction length and a depth direction at its outer side, a larger size lattice horn can be available. Hence, a limit frequency of a high-pitched sound which may be lowest in its high-pitched sound region can be lowered more, and a higher sound pressure can be obtained, and a clearer intermediate-pitched sound and high-pitched sound can be reproduced.

3. If the lattice array speaker system according to the present invention is employed, a wave front can actually form one plane wave at a portion where the high-pitched sound reproduced from a plurality of lattice type speakers are superposing, which makes it possible to prevent any interference phenomenon, whereby a high-pitched sound can be well transferred irrespective of the position of audience in a spacious performing theater.

The additional advantages of the present invention may become apparent from the following descriptions with reference to the attaching drawings which indicating the components with the same or similar reference numbers.

MODES FOR CARRYING OUT THE INVENTION

The present invention will be described with reference to the embodiments and drawings of the present invention.

Figure 2A:
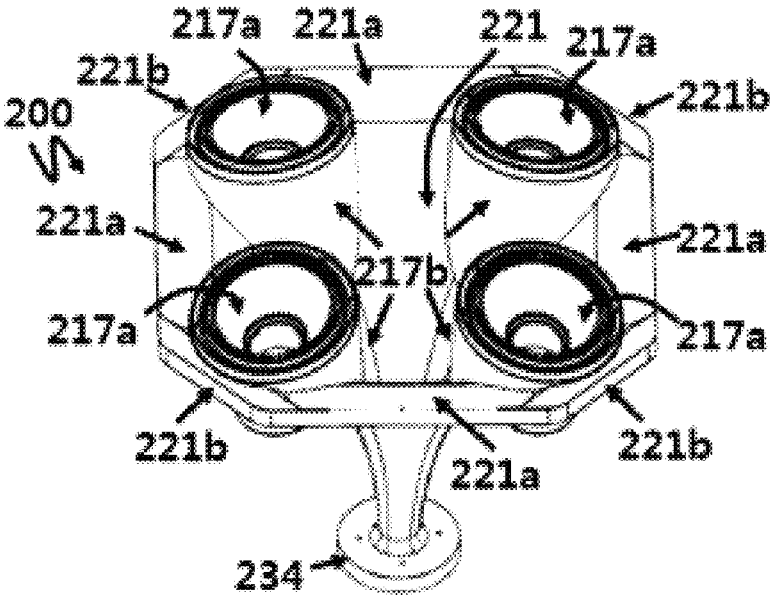
FIG. 2A is an upper perspective view illustrating a lattice type speaker according to the first embodiment of the present invention.
Figure 2B:
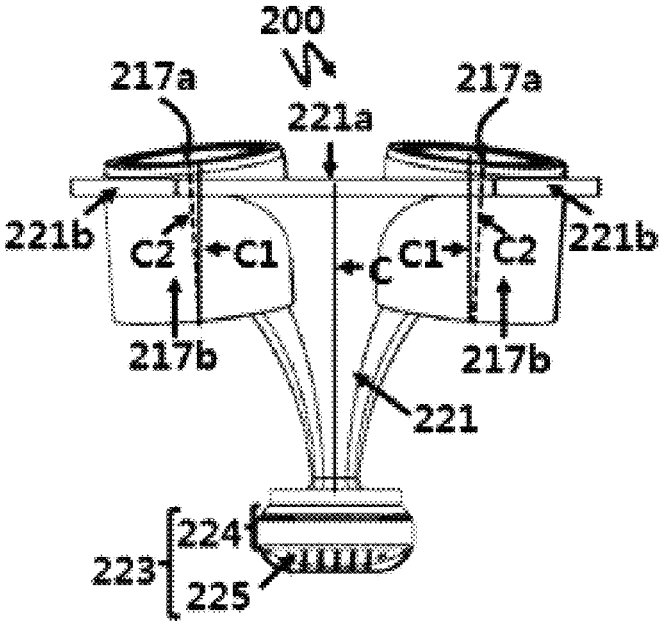
FIG. 2B is a side view illustrating a lattice type speaker according to the first embodiment of the present invention in FIG. 2A.
Figure 2C:
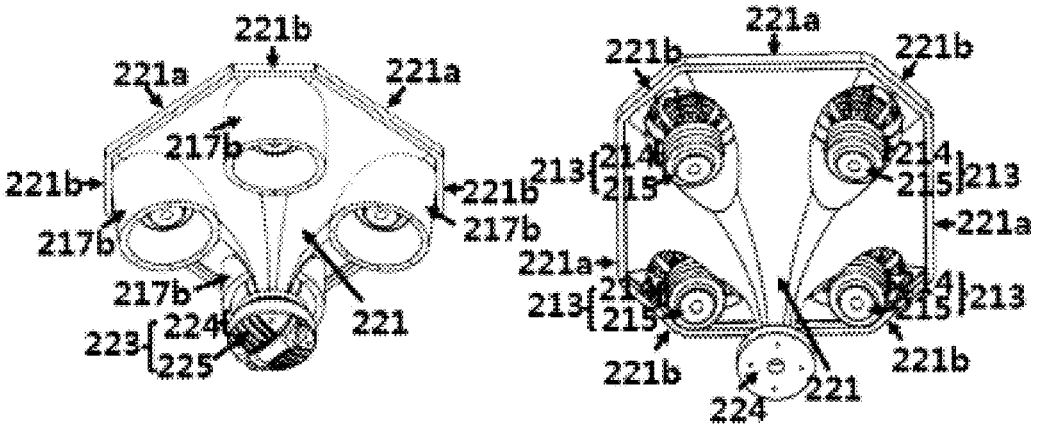
FIG. 2C is a lower perspective view illustrating a lattice type speaker and a lower perspective view illustrating a state where a woofer horn cover is removed, according to the first embodiment of the present invention in FIG. 2A.
Figure 2D:
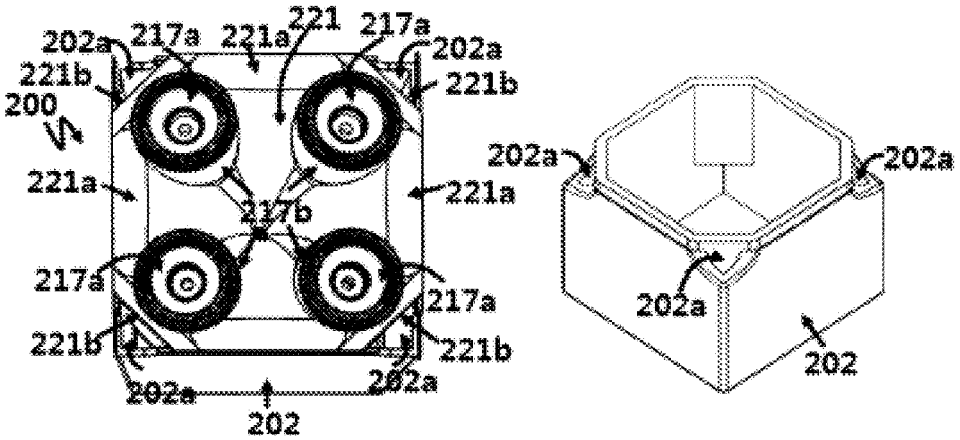
FIG. 2D is an upper perspective view illustrating a state where a lattice type speaker is installed inside of an open type enclosure and a perspective view illustrating an open type enclosure, according to the first embodiment of the present invention.

FIG. 2A is an upper perspective view illustrating a lattice type speaker according to the first embodiment of the present invention. FIG. 2B is a side view illustrating a lattice type speaker according to the first embodiment of the present invention in FIG. 2A. FIG. 2C is a lower perspective view illustrating a lattice type speaker and an upper perspective view illustrating a state where a woofer horn cover is removed, according to the first embodiment of the present invention in FIG. 2A. FIG. 2D is an upper perspective view illustrating a state where a lattice type speaker is installed inside of an open type enclosure and a perspective view illustrating an open type enclosure, according to the first embodiment of the present invention.

Referring to FIG. 2A to FIG. 2D, the lattice type speaker 200 according to the first embodiment of the present invention may include, a tweeter horn 221 which has a quadrangular shape part 221*a*, forming an upper periphery thereof and four woofer frames 217*b* provided at or inside a cut-off edge part 221*b* of the quadrangular shape part 221*a*, so that the tweeter horn 221 is implemented as a lattice horn having a horn type entire body and a cross type when viewed from above; a tweeter driver unit 223 which is provided on a lower side of the tweeter horn 221 and reproduces a high-pitched sound through the tweeter horn 221; four woofer horns 217*a* provided inside the four woofer frames 217*b*, respectively; and a woofer driver unit 223 which is provided on a lower side of the four woofer horns 217*a* and reproduces a low-pitched sound through the four woofer horns 217*a*.

The lattice type speaker 200 according to the first embodiment of the present invention may further include an open type enclosure 202 accommodating the tweeter horn 221 and the tweeter driver unit 223.

The detailed configuration and operation of the lattice type speaker 200 according to the first embodiment of the present invention will be described.

The lattice type speaker 200 according to the first embodiment of the present invention may include the tweeter horn 221. The tweeter horn 221 may be implemented in the form of a lattice horn. The lattice horn has a top surrounding equipped with the quadrangular shape part 221*a*, and the four woofer frames 217*b* are provided at the inner side of the cutoff corner part 221*b* of the quadrangular shape part 221*a*, so the entire body configuration is formed in a horn type and looks like a cross when viewing from the top thereof. Moreover, the four cutoff corner parts 221*b* have the shapes from which right angle triangular parts are cut-off from four apexes of the quadrangular shape part 221*a*. The four woofer frames 217*b* are provided at the inside of the cut-off edge part 221*b*. The four woofer frames 217*b* is disposed passing through in the direction of the tweeter horn 221 (refer to FIG. 2B). In this case, the four woofer frames 217*b* are the open type woofer frames 217*b* the upper and lower of which are open.

Meanwhile, the tweeter drive unit 223 is provided below the tweeter horn 221. The tweeter drive unit 223 may include upper and lower plates, a tweeter magnetic circuit member 224 formed of a magnet disposed between the upper and lower plates, and a tweeter drive unit 225 provided below the tweeter magnetic circuit member 224. The tweeter drive unit 223 is able to reproduce a high-pitched sound through the tweeter horn 221.

Meanwhile, the lattice type speaker 200 according to the first embodiment of the present invention may include four woofer horns 217*a*. The four woofer horns 217*a* are disposed inside of the four woofer frames 217*b* provided at the inside of the cut-off corner parts 221*b* of the tweeter horn 221. In this case, the four woofer horns 217*a* may be provided slanted at a predetermined angle in the direction of the cut-off corner part 221*b* (namely, along the direction "C2") with respect to the woofer center axis "C1" being parallel with the tweeter center axis "C" of the tweeter horn 221 (refer to FIG. 2B). It, however, it obvious to a person having ordinary skill in the art that the four woofer horns 217*a* can be disposed in the same direction (then, in the slanted state along the direction "C1") as the direction of the woofer center axis "C1".

Moreover, the woofer driver unit 213 is provided below the four woofer horns 217*a*. The woofer driver unit 213 may include upper and lower plates, a woofer magnetic circuit member 214 form of a magnet provided between the upper and lower plates, and a woofer drive part 215 provided below the woofer magnetic circuit member 214. The woofer driver unit 213 is able to reproduce a low-pitched sound through the four woofer horns 217*a*.

Furthermore, the lattice type speaker 200 according to the first embodiment of the present invention may further include an open type enclosure 202. The open type enclosure 202 is configured to accommodate the tweeter horn 221 and the tweeter driver unit 213. The open type enclosure 202 may include a duct 202*a* at a portion corresponding to the four cutoff corner parts 221*a* of the tweeter horn 221. If this open type enclosure 202 is used, a low-pitched sound produced by the woofer driver unit 213 can be reproduced through the four woofer horns 217*a*, and it may be reflected off in the open type enclosure 202 through the open lower side of the four woofer frames 217*b* and then may be transferred through the four ducts 202*a*, thus further producing a good low-pitched sound.

Figure 2E:
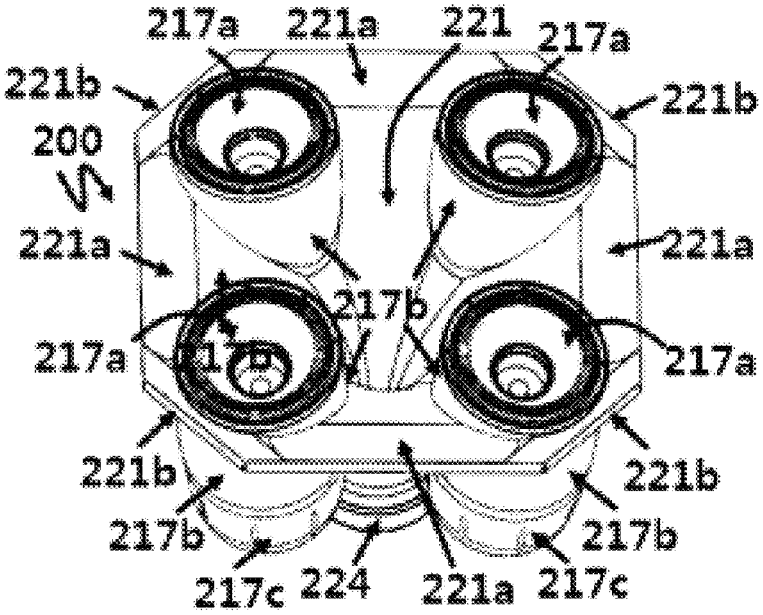
FIG. 2E is an upper perspective view illustrating a lattice type speaker according to the second embodiment of the present invention.
Figure 2F:
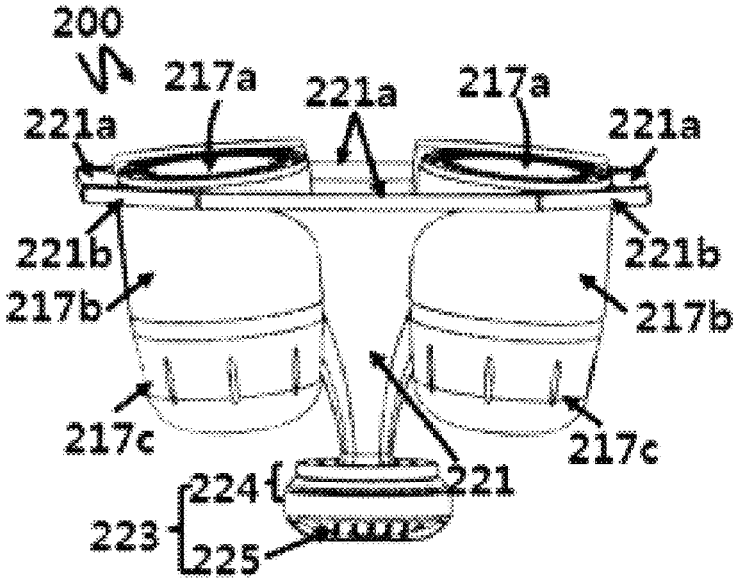
FIG. 2F is a side view illustrating a lattice type speaker according to the second embodiment of the present invention in FIG. 2E.

FIG. 2E is an upper perspective view illustrating the lattice type speaker according to the second embodiment of the present invention, and FIG. 2F is a side view illustrating the lattice type speaker according to the second embodiment of the present invention in FIG. 2E.

Referring to FIGS. 2E and 2F together with FIG. 2A to FIG. 2D, the lattice type speaker 200 according to the second embodiment of the present invention actually has the same configuration as the configuration of the lattice type speaker 200 according to the first embodiment of the present invention illustrated in FIG. 2A to FIG. 2D, except for the configuration wherein there is provided a woofer horn cover 217*c* engaged to the lower portions of the four woofer frames 217*b* where the four woofer horns 217*a* are provided.

If this woofer horn cover 217*c* is employed, the low-pitched sound produced by the woofer driver unit 213 may be blocked by the woofer horn cover 217*c*, and then the volume of the low-pitched sound transferred into the open enclosure 202 may not be enough, for which the volume of the low-pitched sound reflected inside of the open enclosure 202 and transferred through the four ducts 202*a* may decrease, so the further production of a good low-pitched sound may be decreased. In order to overcome this problem, a separate low-pitched sound drive unit may be employed in the present invention.

Figure 2G:
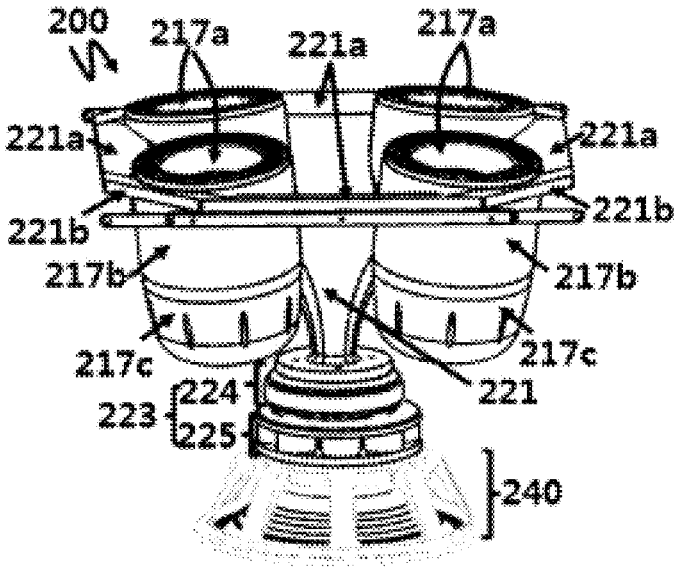
FIG. 2G is a perspective view of a modified embodiment of a lattice type speaker according to the second embodiment of the present invention.

More specifically, FIG. 2G is a perspective view of a modified embodiment of the lattice type speaker according to the second embodiment of the present invention in FIG. 2F.

Referring to FIG. 2G together with FIG. 2A to FIG. 2F, the lattice type speaker 200 according to a modified embodiment from the second embodiment of the present invention may further include a low-pitched sound driver unit 240 disposed below the tweeter driver unit 223 of the lattice type speaker 200 according to the second embodiment of the present invention in FIG. 2F. It does not need to necessarily use the low-pitched sound unit 240 as an optional component. The low-pitched sound unit 240, for example, may have the same configuration as the woofer driver unit 213. In this case, the low-pitched sound transferred into the open type enclosure 202 among the low-pitched sound produced by the woofer drive unit 213 and the low-pitched sound produced by the low-pitched sound drive unit 240 may be reflected inside of the open type enclosure 202 and may be transferred through the four ducts 202*a*, by means of which a good reproduction of a low-pitched tone can be available.

Alternatively, the low-pitched sound unit 240 in FIG. 2G may have a configuration different from the woofer driver unit 213. More specifically, the woofer driver unit 213 may be configured to produce an intermediate-pitched sound which is a relatively higher sound, and the low-pitched sound drive unit 240 may be configured to produce a low-pitched sound which is a relatively lower sound. In this case, the lattice type speaker 200 according to a modified embodiment of the present invention in FIG. 2G may have the function of a speaker which is able to produce and reproduce a high-pitched sound by the tweeter driver unit 223, an intermediate-pitched tone by the woofer driver unit 213 and a low-pitched sound by the low-pitched sound drive unit 240.

Figure 2H:
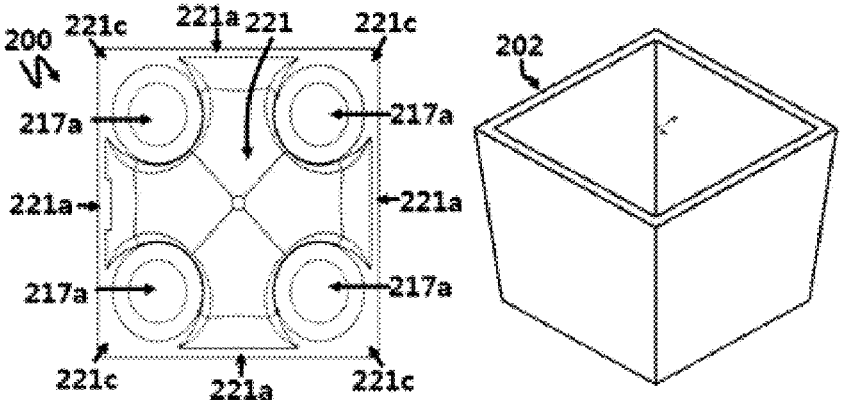
FIG. 2H is an upper view of a modified embodiment wherein a quadrangular shape part of the top of a lattice horn have four right angle corners and a perspective view illustrating a closed type enclosure, according the first and second embodiment of the present invention in FIG. 2A to FIG. 2G.

FIG. 2H is a plane view of a modified embodiment wherein the quadrangular shape part of the top of the lattice horn has four right angle corner parts and a perspective view illustrating a closed type enclosure in a lattice type speaker according the first and the second embodiments of the present invention in FIG. 2G.

Referring to FIG. 2H together with FIG. 2A to FIG. 2G, the lattice type speaker 200 according to a modified embodiment of the present invention may actually have the same configuration as the configuration of the lattice type speaker 200 according to the embodiments of the present invention in FIG. 2A to FIG. 2G except for the configuration wherein the top portion of the tweeter horn 221 implemented with the lattice horn includes the quadrangular shape part 221*a* having four right angle corner parts 221*c* as in FIG. 2A to FIG. 2G, and the closed type enclosure 202 is employed instead of the open type enclosure 202 in FIG. 2D. Hence, according to the lattice type speaker 200 according to a modified embodiment of the present invention, the four woofer frames 217*b* may be provided at the inner side of the right angle corner part 221*c* of the quadrangular shape part 221*a*.

The lattice type speaker 200 according to a modified embodiment of the present invention in FIG. 2H may further include a closed type enclosure 202. Inside of the closed type enclosure 202, the tweeter horn 221 and the tweeter driver unit 223 of the lattice type speaker 200 according to the present invention in FIG. 2A to FIG. 2F may be built in or the tweeter horn 221, the tweeter driver unit 223 and the low-pitched sound drive unit 240 of the lattice type speaker 200 of the present invention in FIG. 2G may be built in. It is obvious that this closed type enclosure 202 does not include the duct 202*a* of the open type enclosure 202 in FIG. 2D. Hence, a part of each of the low-pitched sound and high-pitched sound produced from the woofer horn 217*a* and the tweeter horn 221 may be reflected inside of the closed type enclosure 202, thus increasing the volumes of the low-pitched sound and the high-pitched sound, and the low-pitched sound can be reproduced well, and the sound quality of the high-pitched sound can be enhanced.

Figure 2I:
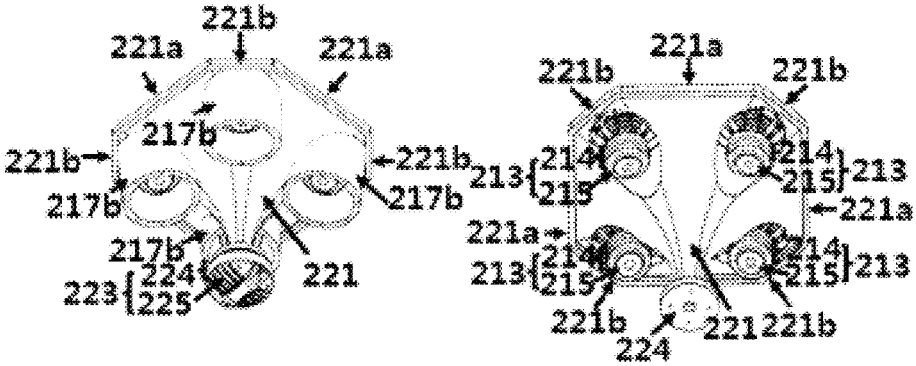
FIG. 2I is a lower perspective view and a sectional plane view illustrating that a lattice type speaker has four ducts at a quadrangular shape part of a lattice horn according to a modified embodiment of the present invention in FIG. 2H.

FIG. 2I is a lower perspective view and a plane view illustrating a configuration wherein the lattice type speaker according to a modified embodiment of the present invention in FIG. 2H includes four ducts at the top of the quadrangular shape part of the lattice horn.

Referring to FIG. 2I together with FIG. 2H, the lattice type speaker 200 according to a modified embodiment of the present invention may actually have the same configuration as the lattice type speaker 200 according to a modified embodiment of the present invention in FIG. 2H except for a configuration wherein four ducts 202*b* are further provided at the top of the quadrangular shape part 221*a* of the tweeter horn 221 and between the neighboring woofer frames 217*b*. In the lattice type speaker 200 according to a modified embodiment in FIG. 2I, since the four ducts 202*b* are provided at the top of the quadrangular shape part 221*a* of the tweeter horn 221, the closed type enclosure 202 in FIG. 2H may be additionally included. In this case, the low-pitched sound produced by the woofer drive unit 213 of the lattice type speaker 200 in FIG. 2A to FIG. 2F, the woofer driver unit 213 of the lattice type speaker 200 in FIG. 2G and the low-pitched sound drive unit 240 may be reflected inside of the closed type enclosure 202, and may be transferred through the four ducts 202*b* provided at the top of the quadrangular shape part 221*a*.

It is obvious that the four ducts 202*b* in FIG. 2I may extend from the quadrangular shape part 221*a* of the tweeter horn 221 up to a part of the horn shape of the tweeter horn 221 (refer to FIG. 2I).

Figure 2J:
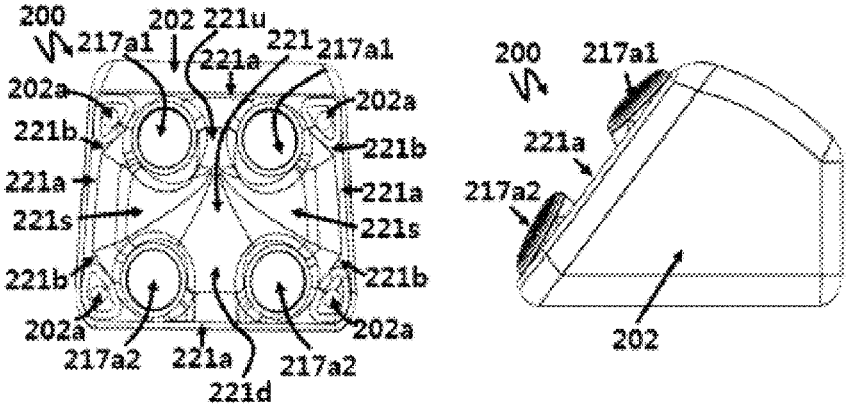
FIG. 2J is an upper perspective view and a side view illustrating a lattice type speaker according to the third embodiment of the present invention.
Figure 2K:
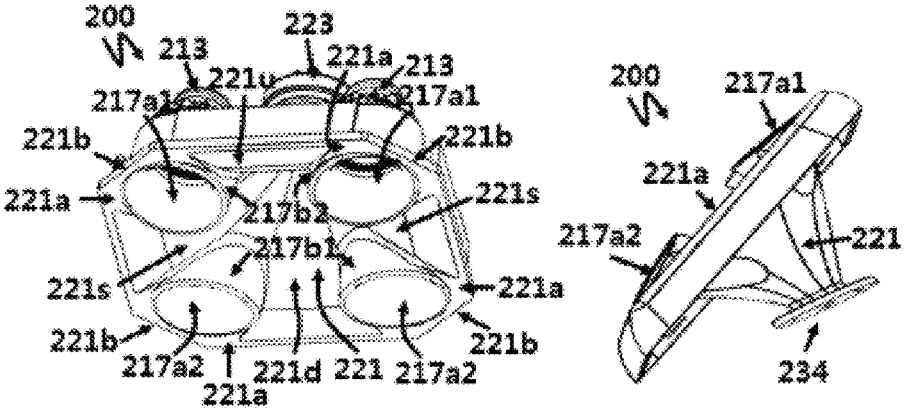
FIG. 2K is a perspective view and a side view illustrating a state where an open type enclosure of a lattice type speaker is removed according to the third embodiment of the present invention in FIG. 2J.

FIG. 2J is an upper perspective view and a side view illustrating a lattice type speaker according to the third embodiment of the present invention, and FIG. 2K is a perspective view and a side view illustrating a state where an open type enclosure of a lattice type speaker is removed according to a third embodiment of the present invention in FIG. 2J.

Referring to FIG. 2J and FIG. 2K together with FIG. 2A to FIG. 2I, the lattice type speaker 200 according to the third embodiment of the present invention may include a tweeter horn 221 which includes a top surrounding having a quadrangular shape part 221*a*, wherein two upper and lower woofer frames 217*b*1 and 217*b*2 are provided at the upper and lower portions at an inner side of a cutoff cornet part 221*a* or quadrangular corner part (not illustrated) of the quadrangular shape part 221*a*, and the upper and lower portions of the entire inside body are formed in an asymmetrical horn shape, and the tweeter horn is implemented with an asymmetrical lattice horn looking like a cross when viewing from the top thereof; a tweeter drive unit 223 which is provided below the tweeter horn 221 and is able to reproduce a high-pitched sound through the tweeter horn 221; two upper and lower woofer horns 217*a*1 and 217*a*2 which are disposed inside of the two upper and lower woofer frames 217*b*1 and 217*b*2; and a woofer drive unit 213 which is provided below each of the two upper and lower woofer horns 217*a*1 and 217*a*2 and are able to reproduce a low-pitched tone through the two upper and lower woofer horns 217*a*1 and 217*a*2.

The quadrangular corner parts (not illustrated) of the quadrangular shape part 221*a* may be implemented with the right angle corner part 221*c* in FIGS. 2H and 2I (in this case, the quadrangular shape part 221*a* may be a square shape or a rectangular shape, and the spaced interval between the two upper woofer frames 217*b*1 and the spaced interval between the two lower woofer frames 217*b*2 are same) or the two upper corner parts may be obtuse angle corner parts the angles of which are larger than 90°, and the two lower corner parts may be acute angle corner parts the angles of which are smaller than 90° (hereinafter referred to "a quadrangular corner part") (in this case, the quadrangular shape part 221*a* is a trapezoid shape, and the spaced interval between the two upper woofer frames 217*b*1 is shorter than the spaced interval between the two lower woofer frames 217*b*2).

Moreover, the lattice type speaker 200 according to the third embodiment of the present invention may be implemented in such a way that the tweeter horn 221 is formed of an asymmetric lattice horn. More specifically, the tweeter horn 221 has the shape of the asymmetric lattice horn wherein the length of an upper horn portion 221*u* is short, and the length of a lower horn portion 221*d* is long, and in two side horn portions 221*s*, the length of the portion connected to the upper horn portion 221*u* is shorter than the length of the portion connected to the lower horn portion 221*d*.

Moreover, inside of the lattice type speaker 200 according to the third embodiment of the present invention, the tweeter horn 221 and the tweeter drive unit 223 are built in, and an open type enclosure 202 equipped with the duct 202*a* may be further provided at a portion corresponding to the cutoff corner part 221*a*.

Alternatively, in the lattice type speaker 200 according to the third embodiment of the present invention, the quadrangular shape part 221*a* may be implemented with the right angle corner part 221*c* in FIG. 2H or the quadrangular shape part 221*a* having a quadrangular corner part (not illustrated). In this case, the lattice type speaker 200 according to a third embodiment of the present invention may further include a closed type enclosure 202 which is not equipped with the duct 202*a*, instead of the open type enclosure 202 having the duct 202*a* in FIG. 2J.

It is obvious to a person having ordinary skill in the art that the lattice type speaker 200 according to the third embodiment of the present invention may employ the woofer horn cover 217*c* in FIG. 2E and FIG. 2F, the low-pitched tone drive unit 240 in FIG. 2G, and the four ducts 202*b* provided at the top of the quadrangular shape part 221*a* of the tweeter horn 221 in FIG. 2I.

In the lattice type speaker 200 according to the third embodiment of the present invention, since a high-pitched tone can be more well transferred in the direction of the longer lower horn part 221*d* than the short upper horn part 221*u* with the aid of the tweeter horn 221 implemented with an asymmetrical lattice horn, the high-pitched tone can have an orientation in a predetermined direction (the downward directions in FIG. 4J and FIG. 4K). For this reason, if the lattice type speaker 200 according to a third embodiment of the present invention is employed, a high-pitched tone can be substantially well transferred in a predetermined direction.

Figure 2L:
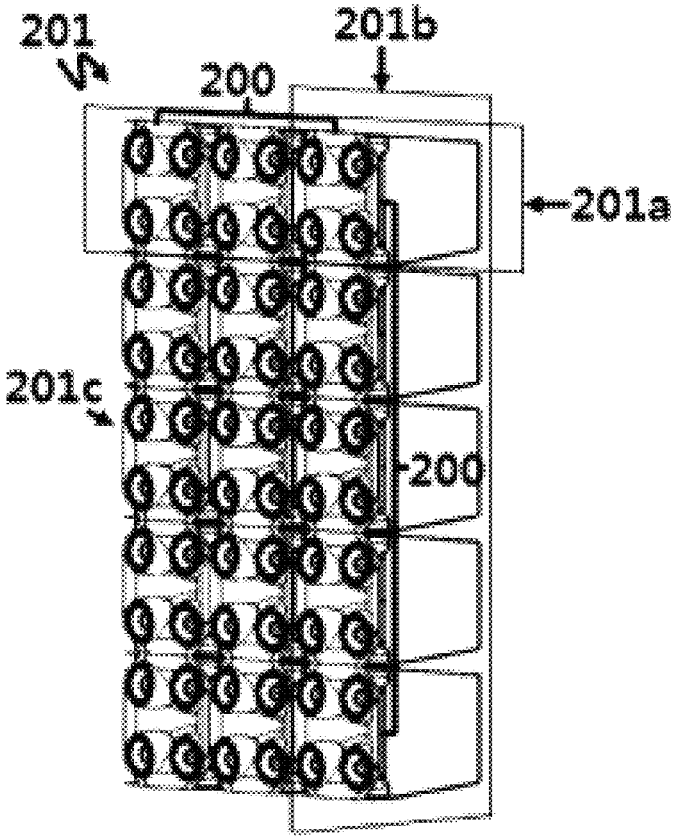
FIG. 2L is a view illustrating a lattice array speaker system according to the first embodiment of the present invention.

FIG. 2L is a view illustrating a lattice array speaker system according to the first embodiment of the present invention. The lattice array speaker system according to the first embodiment of the present invention in FIG. 2L is directed to a plane lattice array speaker system.

Referring to FIG. 2L, the plane lattice array speaker system 201 according to the first embodiment of the present invention may include a plurality of lattice type speakers 200 which are arranged in a horizontal plane direction or a vertical plane direction. A plurality of the lattice type speakers 200 may be implemented with the lattice type speakers 200 in FIGS. 2A to 2I.

More specifically, each of a plurality of the lattice type speakers may include a tweeter horn 221 which includes a top surrounding having a quadrangular shape part 221*a*, wherein four woofer frames 217*b* are provided at an inner side of a cutoff corner part 221*b* or right angle corner part 221*c* of the quadrangular shape part 221*a*, and the entire body configuration is formed in a horn shape, and the tweeter horn is implemented with a lattice horn looking like a cross when viewing from the top thereof; a tweeter drive unit 223 which is provided below the tweeter horn 221 and is able to reproduce a high-pitched tone through the tweeter horn 221; four woofer horns 217*a* which are disposed inside of the four woofer frames 217*b*; and a woofer driver unit 213 which is provided below the four woofer horns 217*a* and are configured to reproduce a low-pitched sound through the four woofer horns 217*a* (refer to the lattice type speaker system 200 in FIG. 2A to FIG. 2*l*).

The lattice array speaker system 201 wherein a plurality of the lattice type speakers 200 are arranged and connected along a horizontal direction plane may be directed to a horizontal direction plane lattice array speaker system 201*a*, and the lattice array speaker system 201 wherein a plurality of the lattice type speakers 200 are arranged and connected along a vertical direction plane may be directed to a vertical direction plane lattice speaker system 201*b*, and the lattice array speaker system 201 wherein a plurality of the lattice type speakers 200 are arranged and connected along the horizontal direction and vertical direction planes may be directed to a 3-dimensional plane lattice array speaker system 201*c*, all of which may be collectively called a plane lattice array speaker system 201.

Figure 2M:
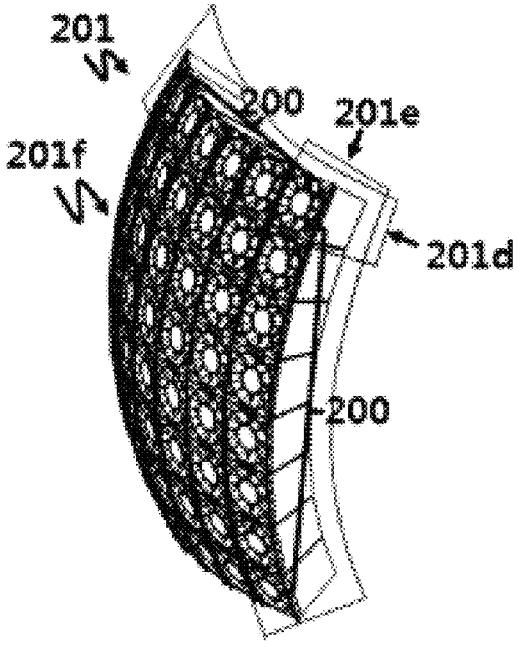
FIG. 2M is a view illustrating a lattice array speaker system according the second embodiment of the present invention.

FIG. 2M is a view illustrating a lattice array speaker system according to the second embodiment of the present invention. The lattice array speaker system according to the second embodiment of the present invention in FIG. 2M is directed to a curved surface lattice array speaker system.

Referring to FIG. 2M, the lattice array speaker system 201 according to the second embodiment of the present invention may include a plurality of lattice type speakers 200 which are arranged and connected along any of a first curved surface in the horizontal direction and a second curved surface in the vertical direction or along both the curved surfaces, and a plurality of the lattice type speakers 200 may be implemented with the lattice type speakers 200 in FIG. 2A to FIG. 2I.

A plurality of the lattice type speakers 200 may include a tweeter horn 221 which includes a top surrounding having a quadrangular shape part 221*a*, wherein four woofer frames 217*b* are provided at an inside of a cut-off corner part 221*b* or right angle corner part 221*c* of the quadrangular shape part 221*a*, and the entire body configuration is formed in a horn type, and the tweeter horn 221 is implemented with a lattice horn looking like a cross when viewing from the top thereof; a tweeter drive unit 223 which is provided below the tweeter horn 221 and is able to reproduce a high-pitched sound through the tweeter horn 221; four woofer horns 217*a* which are disposed inside of the four woofer frames 217*b*; and a woofer drive unit 213 which is provided below the four woofer horns 217*a* and are configured to reproduce a low-pitched sound through the four woofer horns 217*a* (refer to the lattice type speaker 200 in FIG. 2A to FIG. 2I).

The lattice array speaker system 201 wherein a plurality of the lattice type speakers 200 are arranged and connected along a first curved surface in the horizontal direction may be directed to a horizontal direction curved surface lattice array speaker system 201*d*, and the lattice array speaker system 201 wherein a plurality of the lattice type speakers 200 are arranged and connected along a second curved surface in the vertical direction may be directed to a vertical direction curved surface lattice array speaker system 201*e*, and the lattice array speaker system 201 wherein a plurality of the lattice type speakers 200 are arranged and connected along a curved surface in the horizontal and vertical directions may be directed to a 3D curved surface lattice array speaker system 201*f*, all of which may be collectively called a curved surface lattice array speaker system 201.

Figure 2N:
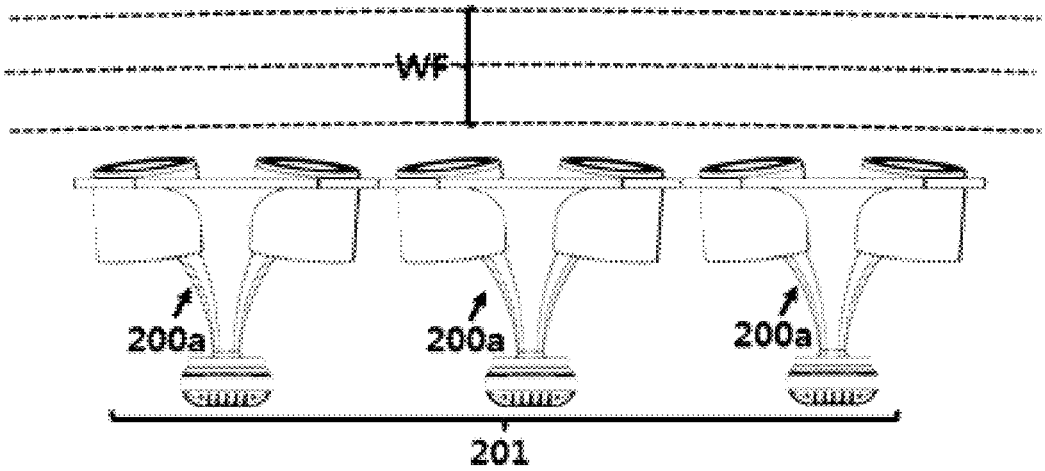
FIG. 2N is a view illustrating a propagation state of wave fronts of the high-pitched sound reproduced by a plurality of lattice type speakers according the first and the second embodiments of the present invention in FIGS. 2L and 2N.

FIG. 2N is a view illustrating a propagation state of a high-pitched sound wave front which occurs by a plurality of lattice type speakers used for the lattice array speaker systems according to the first and the second embodiments of the present invention in FIGS. 2L and 2M.

Figure 1A:
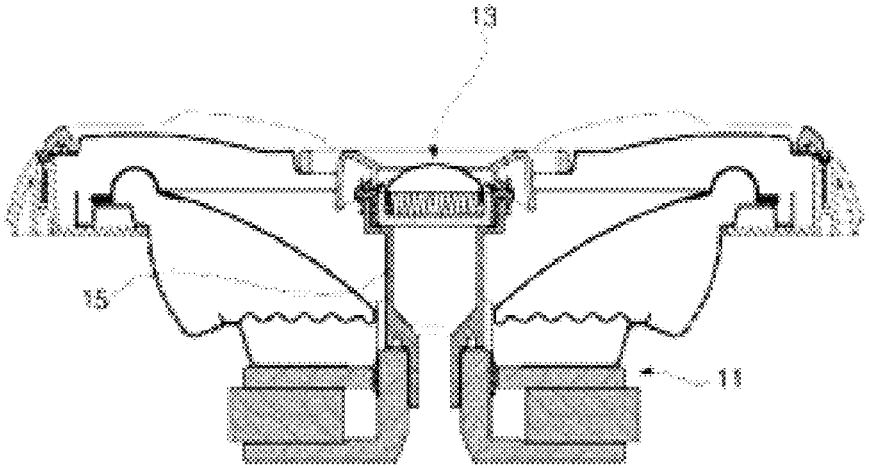
FIG. 1A is a cross-sectional illustrating a conventional technology coaxial speaker.
Figure 1B:
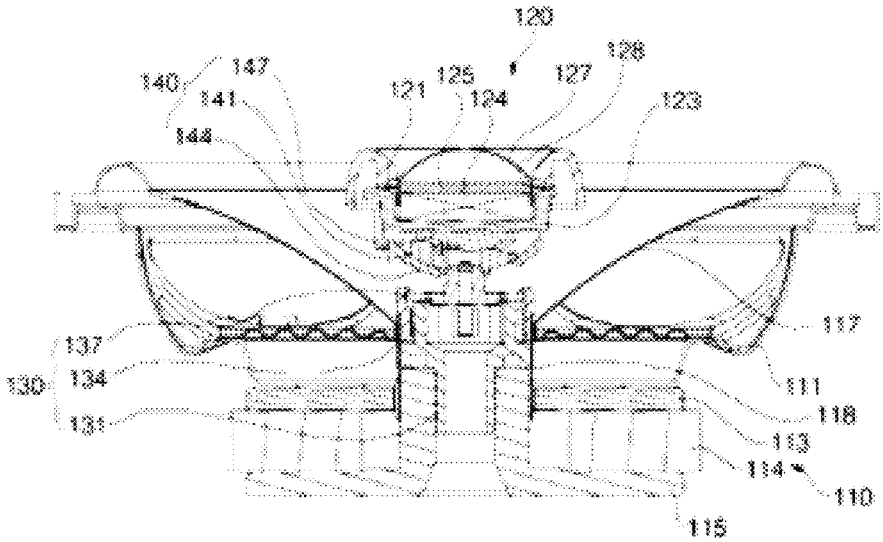
FIG. 1B is a cross-sectional view illustrating a conventional technology improved coaxial speaker.
Figure 1C:
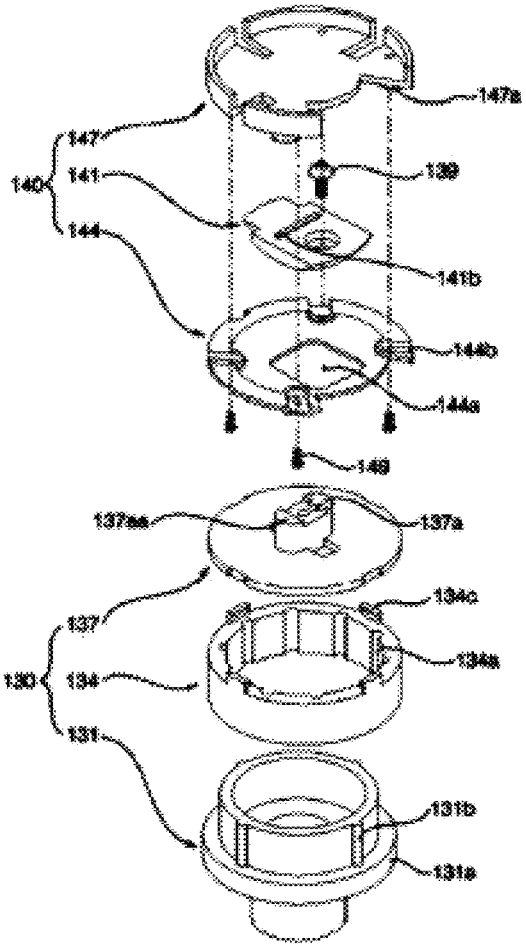
FIG. 1C is a disassembled perspective view illustrating the first and the second support members in FIG. 1B.
Figure 1D:
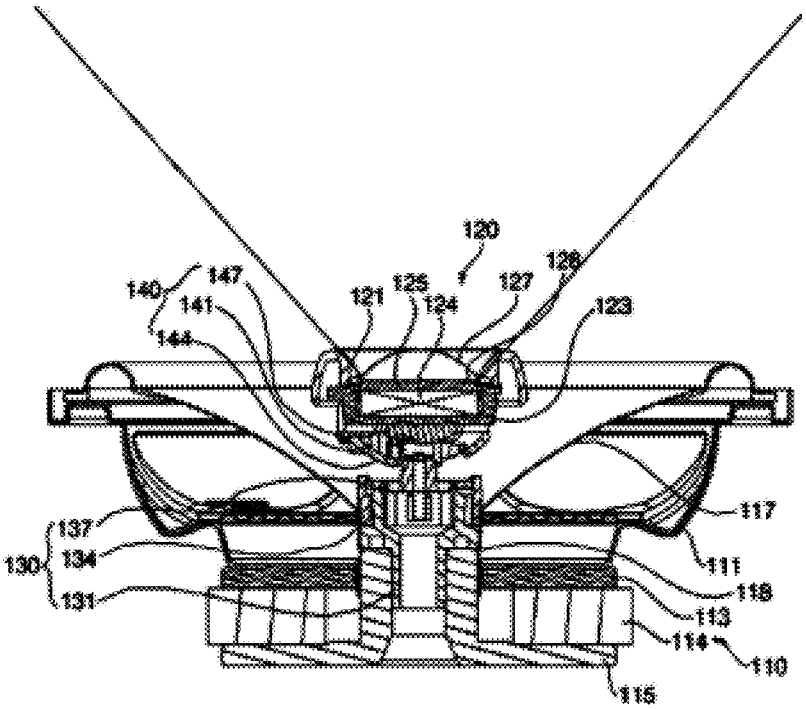
FIG. 1D is a view for describing a problem in a high-pitched sound speaker of a conventional improved coaxial speaker in FIG. 1B.
Figure 1E:
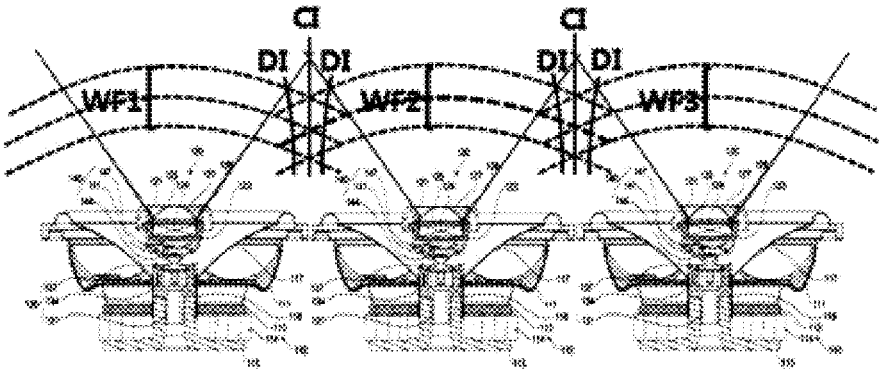
FIG. 1E is a view schematically illustrating a propagation state of a high-pitched sound if a line speaker system wherein a plurality of conventional technology coaxial speakers are connected in a direction is employed.

Referring to FIG. 2N together with FIG. 2A to FIG. 2I, the tones implemented with the lattice horns of a plurality of the lattice type speakers 220 used in the lattice array speaker systems 201 according to the first and second embodiments of the present invention may be transferred along the tweeter horns 221*a*. In this case, since the quadrangular shape parts 221*a* of a plurality of the tweeter horns 221 are arranged contacting with each other, the wave front (WF) of the high-pitched sound propagated along a plurality of the tweeter horns 221 may substantially form one plane wave as in FIG. 2N. In this way, any interference phenomenon does not occur between numerous high-pitched sound which are transferred through a plurality of the tweeter horns 221 as compared to the conventional technology in FIG. 1E.

In the lattice type speaker 200 and the lattice array speaker system 201 according to the present invention described so far with reference to FIG. 2A to FIG. 2N, since the lattice horn has a large orientation angle in the direction of a cross type, the transfer distances of the high-pitched sound and the low-pitched sound produced by the lattice type speakers 200 can be greatly increased, thus resolving a problem wherein the high-pitched sound is not transferred well or the high-pitched sound is transferred weak.

Moreover, since the sounds can focus on in a predetermined direction with the aid of the lattice type speakers 200, the transfer distance and range of the high-pitched tone and the low-pitched sound can greatly increase. Consequently, a desirable sound field can be formed, wherein the entire transfer distance of the sound is wider and farther as compared to the conventional art, whereby a desirable acoustic effect can be obtained in a wider space.

In case of the lattice horn used in the lattice type speaker 200, the lengths in the horizontal and vertical directions of the outer portions thereof and the length in the depth direction can be increased, a larger lattice horn can be available, for which the limit frequency of the high-pitched sound which is the lowest among the high-pitched sound regions can be lowered more, and a high sound pressure can be provided, which makes it possible to implement a clearer intermediate-pitched tone and high-pitched sound reproduction.

Moreover, if the lattice array speaker system 201 according to the present invention is employed, the wave fronts may actually form one plane wave at a portion where the high-pitched sound produced from a plurality of lattice type speakers 200 are superposing, thus preventing any interference phenomenon, whereupon a high-pitched tone can be well transferred irrespective of the position of audience in a relatively spacious performing theater.

INDUSTRIAL APPLICABILITY

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A lattice type speaker, comprising:

a tweeter horn which includes a top surrounding having a quadrangular shape part, wherein four woofer frames are provided at an inner side of a cut-off corner part or corner part of the quadrangular shape part, and the entire body configuration is formed in a horn type, and the tweeter horn is implemented with a lattice horn;

a tweeter drive unit which is provided below the tweeter horn and is able to reproduce a high-pitched sound through the tweeter horn;

four woofer horns which are disposed inside of the four woofer frames, wherein the four woofer frames are disposed passing through a side wall of the tweeter horn in the vertical direction of the tweeter horn; and woofer driver units which are provided below the four woofer horns and are configured to reproduce a low-pitched sound through the four woofer horns.

2. The speaker of claim 1, wherein the four woofer horns are slanted at a predetermined angle parallel to the cutoff corner part and off-axis relative to a woofer center axis.

3. The speaker of claim 1, wherein the lattice type speaker includes a woofer horn cover which is engaged to a lower portion of each of the four woofer frames, and includes a low-pitched sound drive unit which is disposed below the tweeter drive unit.

4. The speaker of claim 1, wherein if the quadrangular shape part includes a right angle corner part, the lattice type speaker further includes four ducts which are disposed at the tops of the quadrangular shape parts between the four neighboring woofer frames.

5. The speaker of claim 4, wherein the four ducts extend from the quadrangular shape part to a part of the horn type of the tweeter horn.

6. The speaker of claim 4, wherein the lattice type speaker further includes a closed type enclosure in which the tweeter horn and the tweeter drive unit are built.

7. The speaker of claim 1, wherein if the quadrangular shape part includes the cutoff corner part, the lattice type speaker further includes an open type enclosure in which the tweeter horn and the tweeter driver unit are built in and which includes the ducts at a portion corresponding to the cutoff corner part.

8. The speaker of claim 1, wherein if the quadrangular shape part includes a right angle corner part, the lattice type speaker further includes a closed type enclosure in which the tweeter horn and the tweeter driver unit are built.

9. A lattice type speaker, comprising:

a tweeter horn which includes a top surrounding having a quadrangular shape part, wherein two upper and lower woofer frames are provided at the upper and lower portions at an inside of a cut-off cornet part or quadrangular corner part of the quadrangular shape part, and the upper and lower portions of the entire inside body are formed in an asymmetrical horn type, and the tweeter horn is implemented with an asymmetrical lattice horn;

a tweeter drive unit which is provided below the tweeter horn and is able to reproduce a high-pitched sound through the tweeter horn;

two upper and lower woofer horns which are disposed inside of the two upper and lower woofer frames, wherein the two upper and lower woofer frames are disposed passing through a side wall of the tweeter horn in the vertical direction of the tweeter horn; and woofer drive units which are provided below each of the two upper and lower woofer horns and are able to reproduce a low-pitched sound through the two upper and lower woofer horns.

10. The speaker of claim 9, wherein in the asymmetrical lattice horn, the length of the upper horn portion is short, and the length of the lower horn portion is long, and in two lateral horn portions, the length of a portion connected to the upper horn portion is shorter than the length of a portion connected to the lower horn portion.

11. The speaker of claim 9, wherein the lattice type speaker further includes a woofer horn cover which is engaged to a lower portion of each of the two upper and lower woofer frames, and includes a low-pitched sound drive unit provided below the tweeter driver unit.

12. The speaker of claim 9, wherein if the quadrangular shape part includes a quadrangular corner part, the lattice type speaker further includes four ducts provided at the top of the quadrangular shape part and between the two neighboring upper and lower woofer frames.

13. The speaker of claim 12, wherein the four ducts extend from the quadrangular shape part to a part of the asymmetrical horn shape of the tweeter horn.

14. The speaker of claim 12, wherein the lattice type speaker further includes a closed type enclosure in which the tweeter horn and the tweeter drive unit are built.

15. The speaker of claim 9, wherein if the quadrangular shape part includes a cut-off corner part, the lattice type speaker further includes an open type enclosure in which the tweeter horn and the tweeter drive unit are built, wherein a duct is disposed at a portion corresponding to the cut-off cornet part.

16. The speaker of claim 9, wherein the quadrangular shape part includes a quadrangular corner part, the lattice type speaker further includes a closed type enclosure in which the tweeter horn and the tweeter drive unit are built.

17. A lattice array speaker system, comprising:

a plurality of lattice type speakers which are arranged and connected along a plane in a direction between a horizontal plane direction and a vertical plane direction or a plane in both the directions, wherein each of a plurality of the lattice type speakers, comprising:

a tweeter horn which includes a top surrounding having a quadrangular shape part, wherein four woofer frames are provided at an inside of a cut-off corner part or right angle corner part of the quadrangular shape part, wherein the four woofer frames are disposed passing through a side wall of the tweeter horn in the vertical direction of the tweeter horn, and the entire body configuration is formed in a horn shape, and the tweeter horn is implemented with a lattice horn;

a tweeter drive unit which is provided below the tweeter horn and is able to reproduce a high-pitched sound through the tweeter horn;

four woofer horns which are disposed inside of the four woofer frames; and woofer driver units which are provided below the four woofer horns and are configured to reproduce a low-pitched sound through the four woofer horns.

18. The system of claim 17, wherein the four woofer horns are disposed slanted in the direction of the cut-off corner part with respect to a woofer central axis being parallel with a tweeter central axis of the tweeter horn or are disposed not slanted in the same direction as the woofer central axis.

19. The system of claim 17, wherein each of a plurality of the lattice type speakers includes a woofer horn cover which is engaged to a lower portion of each of the four woofer frames, and includes a low-pitched sound drive unit which is disposed below the tweeter drive unit.

20. The system of claim 17, wherein if the quadrangular shape part includes a right angle corner part, each of a plurality of the lattice type speakers further includes four ducts which are disposed at the tops of the quadrangular shape parts between the four neighboring woofer frames.

21. The system of claim 20, wherein the four ducts extend from the quadrangular shape part to a part of the horn shape of the tweeter horn.

22. The system of claim 20, wherein each of a plurality of the lattice type speakers further includes a closed type enclosure in which the tweeter horn and the tweeter driver unit are built.

23. The system of claim 17, wherein if the quadrangular shape part includes the cutoff corner part, each of a plurality of the lattice type speakers further includes an open type enclosure in which the tweeter horn and the tweeter driver unit are built in and which includes the ducts at a portion corresponding to the cutoff corner part.

24. The system of claim 17, wherein if the quadrangular shape part includes a right angle corner part, each of a plurality of the lattice type speakers further includes a closed type enclosure in which the tweeter horn and the tweeter drive unit are built.

25. A lattice array speaker system, comprising:

a plurality of lattice type speakers which are arranged and connected along any of a first curved surface in the horizontal direction and a second curved surface in the vertical direction or along a curved surface in both the directions, wherein each of a plurality of the lattice type speakers, comprising:

a tweeter horn which includes a top surrounding having a quadrangular shape part, wherein four woofer frames are provided at an inside of a cut-off corner part or right angle corner part of the quadrangular type part, and the entire body configuration is formed in a horn type, and the tweeter horn is implemented with a lattice horn;

a tweeter drive unit which is provided below the tweeter horn and is able to reproduce a high-pitched sound through the tweeter horn;

four woofer horns which are disposed inside of the four woofer frames, wherein the four woofer frames are disposed passing through a side wall of the tweeter horn in the vertical direction of the tweeter horn; and woofer driver units which are provided below the four woofer horns and are configured to reproduce a low-pitched sound through the four woofer horns.

26. The system of claim 25, wherein the four woofer horns are disposed slanted in the direction of the cutoff corner part with respect to a woofer central axis being parallel with a tweeter central axis of the tweeter horn or are disposed not slanted in the same direction as the woofer central axis.

27. The system of claim 25, wherein each of a plurality of the lattice type speakers includes a woofer horn cover which is engaged to a lower portion of each of the four woofer frames, and includes a low-pitched sound drive unit which is disposed below the tweeter drive unit.

28. The system of claim 25, wherein if the quadrangular shape part includes a right angle corner part, each of a plurality of the lattice type speakers further includes four ducts which are disposed at the tops of the quadrangular shape parts between the four neighboring woofer frames.

29. The system of claim 28, wherein the four ducts extend from the quadrangular shape part to a part of the horn shape of the tweeter horn.

30. The system of claim 28, wherein each of a plurality of the lattice type speakers further includes a closed type enclosure in which the tweeter horn and the tweeter drive unit are built.

31. The system of claim 25, wherein if the quadrangular shape part includes the cut-off corner part, each of a plurality of the lattice type speakers further includes an open type enclosure in which the tweeter horn and the tweeter drive unit are built in and which includes the ducts at a portion corresponding to the cutoff corner part.

32. The system of claim 25, wherein if the quadrangular shape part includes a right angle corner part, each of a plurality of the lattice type speakers further includes a closed type enclosure in which the tweeter horn and the tweeter drive unit are built.

* * * * *